US008910424B2

(12) United States Patent
Harris

(10) Patent No.: US 8,910,424 B2
(45) Date of Patent: Dec. 16, 2014

(54) PUSH-OUT SCREEN FRAME

(75) Inventor: Patrick William Harris, Kunda Park (AU)

(73) Assignee: Secure Rite Pty Ltd, State of Queensland (AU)

( * ) Notice: Subject to any disclaimer, the term of this patent is extended or adjusted under 35 U.S.C. 154(b) by 215 days.

(21) Appl. No.: 13/487,816

(22) Filed: Jun. 4, 2012

(65) Prior Publication Data

US 2012/0312484 A1 Dec. 13, 2012

(30) Foreign Application Priority Data

Jun. 7, 2011 (AU) ..... 2011902248

(51) Int. Cl.
*E06B 1/04* (2006.01)
*E05B 65/10* (2006.01)

(52) U.S. Cl.
CPC ..... *E05B 65/1033* (2013.01)
USPC ..... 49/504; 49/394

(58) Field of Classification Search
CPC ..... E05B 65/1033
USPC ..... 49/381, 394, 400, 401, 402, 504; 16/355, 356
See application file for complete search history.

(56) References Cited

U.S. PATENT DOCUMENTS

| | | | | |
|---|---|---|---|---|
| 5,809,617 | A * | 9/1998 | Harris et al. | 16/273 |
| 6,145,165 | A * | 11/2000 | Torcato | 16/355 |
| 7,574,773 | B2 * | 8/2009 | Dahl et al. | 16/258 |
| 2003/0110703 | A1 * | 6/2003 | Kobrehel | 49/394 |
| 2008/0295410 | A1 * | 12/2008 | Salerno | 49/394 |
| 2009/0277111 | A1 * | 11/2009 | Albrecht et al. | 52/213 |

* cited by examiner

*Primary Examiner* — Katherine Mitchell
*Assistant Examiner* — Scott Denion
(74) *Attorney, Agent, or Firm* — Abelman, Frayne & Schwab

(57) ABSTRACT

A push-out screen frame including: a fixed frame member having a fixed body portion and an arcuate flange portion extending along one edge thereof; a hinged frame member having a hinged body portion and an arcuate channel along one edge thereof and formed to receive the arcuate flange portion for hinged connection therewith; a swinging frame member having a swinging body portion, a closure formation along an edge thereof and conforming substantially with the arcuate flange portion, and complementary latching and locking formations for latching and locking the hinged frame to the fixed frame; a latching assembly attachable to the fixed body portion and having a latching body portion and a latching formation for latching to the complementary latching formation; and a locking member attachable to a swinging frame member and having a locking body and a locking formation formed for locking engagement with the latching member.

9 Claims, 2 Drawing Sheets

PUSH-OUT SCREEN FRAME

CROSS-REFERENCE TO RELATED APPLICATIONS

This application claims priority to Australian Application No. AU 2011902248, filed Jun. 7, 2011, the disclosure of which is incorporated herein by reference and made a part of this application.

THIS INVENTION relates to a push-out screen frame. The invention has particular application to a push-out screen frame which may be fixed to a frame surrounding an existing opening to a building.

Screens on openings to buildings have been installed for many years, and the safety aspects of such screens has always been of interest. For fire safety, egress through an opening, particularly a window opening relatively close to the ground, has been incorporated into safe building design. One option is to have the screen arranged so that it may be pushed outwards. Although somewhat inappropriate in some circumstances, push-out screens have been mandated by some standards.

This invention aims to provide a push-out screen frame which addresses one or more inefficiencies of the traditional arrangements of the prior art as well as providing for a push-out arrangement for screens installed over openings to buildings. Other aims and advantages of the invention may become apparent from the following description.

With the foregoing in view, in one aspect the present invention resides broadly in a push-out screen frame assembly including:

a fixed frame member having a fixed body portion formed for mounting into an opening in a building and an arcuate flange portion extending along one edge of the fixed body portion, the cross section of the arcuate flange conforming substantially to a portion of a circle such that four such fixed frame members may be formed into a rectangular fixed frame;

a hinged frame member having a hinged body portion and an arcuate channel along one edge of the hinged body portion, the arcuate channel being formed to receive the arcuate flange portion of the fixed frame member for hinged connection of said hinge frame member to one of said fixed frame members;

a swinging frame member having a swinging body portion, a closure formation along an edge of the swinging body portion, the closure formation conforming substantially to at least a part of an outer face of the arcuate flange portion of the fixed frame member, and complementary latching and locking formations along another edge of the swinging body portion such that three such swinging frame members may be formed into a rectangular hinged frame with said hinged frame member, the latching and locking formations being formed for latching and locking the hinged frame to the fixed frame;

a latching assembly attachable to the fixed body portion of at least one of the fixed frame members and having a latching body portion and a latching formation alongside the latching body portion, the latching body portion being formed for latching to the complementary latching formation of the swinging frame member; and a locking member attachable to at least one of the swinging frame members and having a locking body and a locking formation formed for locking engagement with the latching member.

Preferably, the hinged and swinging frame members have substantially the same cross section, the differences between the two sections being the arcuate channel of the hinged frame member and the closure formation of the swinging frame member. The fixed, hinged and swinging frame members may be formed into their respective rectangular frames with mitre joints, with a panel surrounded by the three swinging frame members and the one hinged frame member. The hinged frame surrounds the panel to form a hinged push-out screen frame. The panel may be a panel of screen material or solid material, including glass, mesh or such like.

The fixed frame members may be formed into a rectangular frame sized to fit the hinged push-out screen frame in order to provide a screened door or window opening or the like to a building. It is preferred that the closure formation includes an arcuate face extending through an arc of approximately 90° so that the outer face of the arcuate flange portion of the hinged body portion may meet up to close an opening.

The latching assembly preferably includes a fastening member for fastening to the swinging frame member and a gripping member hingedly attached to the fastening member such that the gripping member may pivot about an axis substantially parallel to the elongate axis of the swinging frame member to which the latching member is attached. In such form, the fixed frame members and the gripping member include complementary lip formations having slanted abutment faces such that the gripping member and the fixed frame member with which it may engage may be locked against unintended disengagement. It is also preferred that biasing means, such as a spring, be interposed between the fastening member and the gripping member for biasing the gripping member away from the fixed frame member and into engagement with the swinging frame member as it is pivoted towards the closure of the opening formed by the fixed frame members by the hinged frame.

Preferably, the locking member includes a C-section flange along one edge of the locking body for attaching the locking member to the swinging frame member. In such form, the fixed frame members include a complementary C-section flange, the inner face of the C-section flange being sized for partially surrounding the outer face of the complementary C-section flange, thereby providing hinged pivotal movement between the locking member and the swinging flange member.

The members forming the frames and other elements are of elongate form having constant cross section, preferably formed by extrusion of metal such as aluminium. Selected faces of the extruded members are powder coated. The locking member may be formed from extruded plastics material, but is preferably extruded aluminium. It is preferred that all structural parts are formed from metal to enable the assembly to meet fire safety standards.

In order that the invention may be more readily understood and put into practical effect, reference will now be made to the accompanying drawings which illustrate an exemplary embodiment of the invention and wherein.

Figure 1:
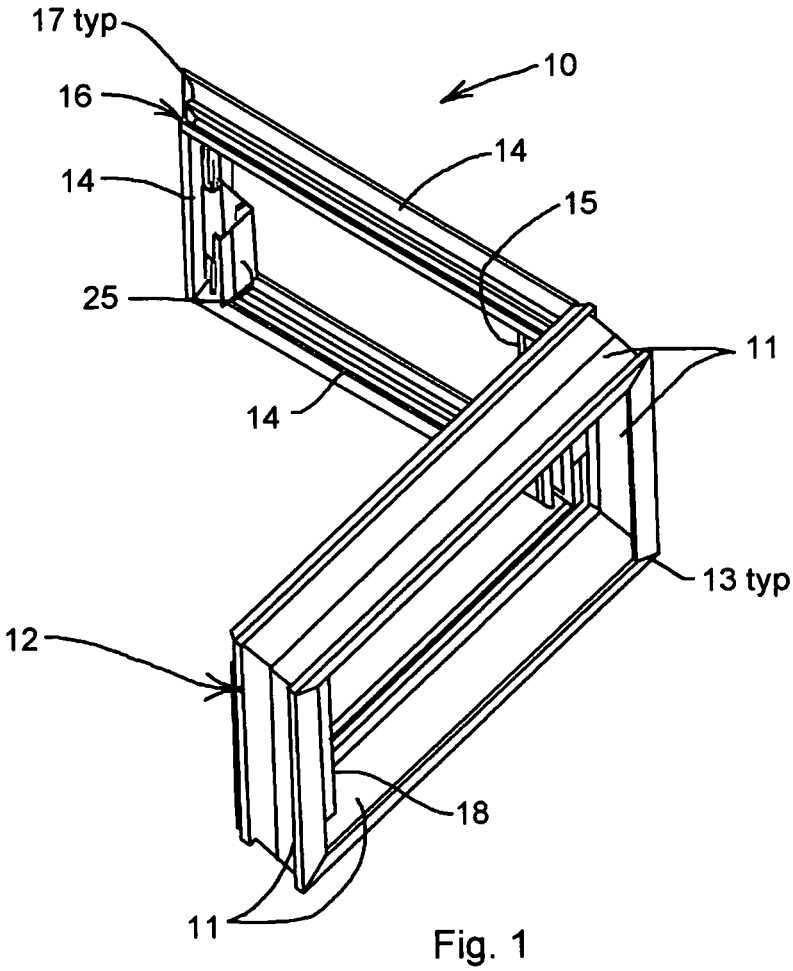
FIG. 1 is a pictorial view of a push-out screen frame according to the invention.
Figure 2:
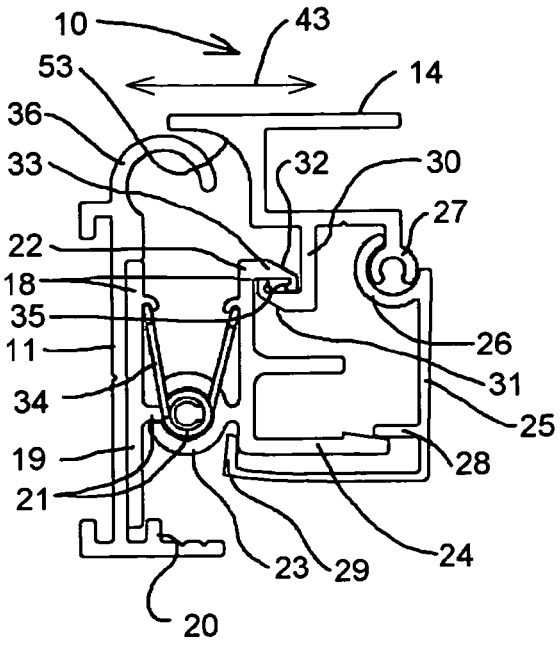
FIG. 2 is a section view showing the fixed, hinged and swinging frame members for the push-out screen frame of FIG. 1.
Figure 3:
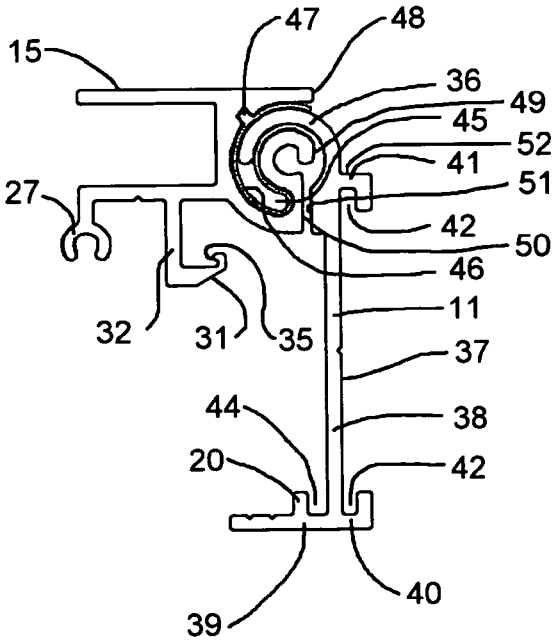
FIG. 3 is a section view showing the latching and locking members for the push-out screen frame of FIG. 1.

The push-out screen frame 10 illustrated in FIGS. 1 to 3 includes four fixed frame members 11 formed into a rectangular fixed frame 12, each fixed frame member having a 45° mitre joint shown typically at 13 at each end. The push-out screen frame further includes three swinging frame members 14 and a hinged frame member 15 formed into a rectangular hinged frame 16, each frame member having a 45° mitre joint shown typically at 17 in similar fashion to the fixed frame.

A latching assembly 18 is attached to one of the fixed frame members by a fastening member 19. The fixed frame members include a fastening flange 20 for receiving the fastening member. The fastening member also includes a spline flange 21, the distal extremity of which includes a circular outer face to which a gripping member 22 is hingedly attached by a C-section flange at 23, referred to for convenience as a gripping member flange. The gripping member has a gripping face flange 24 having a roughened face to aid in the gripping of the gripping member for pivoting with respect to the fastening member and hence also with respect to the fixed frame member to which the fastening member is attached.

A locking member 25 is hingedly attached to the swinging frame member opposite the hinged frame member by way of a C-section flange 26 which engages with a complementary C-section flange 27 on the swinging frame member. The locking member also includes a primary locking flange 28 and a secondary locking flange 29 which co-operate with one another to lock the locking member over the gripping face flange of the gripping member of the latching assembly.

The swinging frame members and hinging member include a striking flange 30 which includes a striking face 31 set at an angle to engage with a complementary striking face 32 on a complementary striking flange 33 along the gripping member to provide for the pivoting of the gripping member with respect to the fastening member against the biasing force of a spring 34 interposed between the gripping member and the fastening member. The striking flange and complementary striking flanges also include complementary lip formations having complementary locking faces 35 formed at an angle such that the fixed flange member and swinging flange member are locked together against separation if there is relative movement between the parts in the direction of arrow 43.

The fixed frame members include an arcuate flange 36 extending along one edge of a fixed body portion 37. The fixed body portion has a main web 38 and a facing flange 39 extending at right angles to the main web along one edge. A pair of mounting lips are provided in spaced relationship with respect to one another, a facing lip 40 and a rear lip 41, which extend outward at right angles to the main web then towards one another to provide mounting channels 42 facing towards one another.

The fastening flange is provided on the opposite side of the main web and is of similar dimensions to that of the facing lip, providing a fastening channel 44, as seen more clearly in the fixed frame member on the right of FIG. 2. It will be seen that the two fixed frame members illustrated are mirror images of one another, and being of a form which provided engagement with both the hinging member and the swinging members, the former being a hinged engagement and the latter being a mating or sealing engagement.

The configuration of the arcuate flange is commensurate with the configuration of an arcuate slot 45 in the hinging member. A sleeve 46 of low friction material, such as polytetrafluoroethylene is inserted into the arcuate slot to provide ease of hinging of the hinging member with respect to the fixed frame member. A keyway and keyway slot 47 is provided along the arcuate slot to prevent the sleeve from coming out of the arcuate slot.

The hinging member also includes substantially aligned abutment faces which co-operate with corresponding abutment faces on the fixed frame member. The abutment faces on the hinging member include an opening abutment face 48, a slot orifice face 49 and a closure face 50. The closure face co-operates with a corresponding closure face 51 on the fixed frame member. The opening abutment face co-operates with a corresponding opening abutment face 52 on the fixed frame member.

The swinging frame members include a closure formation 53 of substantially the same radius as the outer face of the arcuate channel of the hinging member. The closure formation mates with or seals against the outer face of the arcuate flange of the fixed frame member.

In use, a push-out screen frame according to the invention may be installed on an existing window frame by way of the mounting lips on the fixed frame members and a hinged frame mounted thereto by way of hinged engagement of the hinged member of the hinged frame with the arcuate slot of one of the fixed frame members of the fixed frame. The fixed frame may also be mounted for sliding engagement with a window frame if desired. The push-out screen frame may be opened by releasing the locking member and pushing the latching member outwards to release the latch to permit the hinged frame to pivot outward on its hinging member, the assembly being suited, of course, to installations where there is no obstruction to the outward swing of the hinged frame.

When the face flange 24 is pressed outwards, it pushes on the striking flange 30, thereby opening up a gap between the locking member and swinging member. Such action springs open the grill open a small distance, permitting the screen still to be opened when pressure on the locking member is released. Additionally, the hinged member may be replaced by a swinging member with the locking and latching arrangement, thereby providing a form which does not hinge, but pops out wholly when the user wishes to open the screen in an emergency.

Although the invention has been described with reference to a specific example, it will be appreciated by persons skilled in the art that the invention may be embodied in other forms within the broad scope and ambit of the invention as herein set forth and defined by the following claim.

The invention claimed is:

1. A push-out screen frame including:

A fixed frame member having a fixed body portion formed for mounting into an opening in a building and an arcuate flange portion extending along one edge of the fixed body portion, the cross section of the arcuate flange conforming substantially to a portion of a circle, the fixed frame member being so formed that four such fixed frame members may be formed into a rectangular fixed frame;

a hinged frame member having a hinged body portion and an arcuate channel along one edge of the hinged body portion, the arcuate channel being formed to receive the arcuate flange portion of the fixed frame member for hinged connection of said hinge frame member to one of said fixed frame members;

a swinging frame member having a swinging body portion, a concave arcuate closure formation along an edge of the swinging body portion, the closure formation conforming substantially to at least a part of an outer face of the arcuate flange portion of the fixed frame member, and complementary locking formations along another edge of the swinging body portion, the swinging frame member having substantially the same structure as the hinged frame member, but with part of the hinged body portion absent such that an arcuate channel is not formed, such that three such swinging frame members may be formed into a rectangular hinged frame with said hinged frame member, the locking formations being formed for latching and locking the hinged frame to the fixed frame;

a latching assembly attachable to the fixed body portion of at least one of the fixed frame members and having a latching body portion and a latching formation alongside the latching body portion, the latching body portion being formed for latching to the complementary latching formation of at least one of the swinging frame members; and a locking member attachable to at least one of the swinging frame members and having a locking body and a locking formation formed for locking engagement with the latching member.

2. The push-out screen frame according to claim 1, wherein the fixed, hinged and swinging frame members are formed into their respective rectangular frames with mitre joints, with a panel surrounded by the three swinging frame members and the one hinged frame member.

3. The push-out screen according to claim 2, wherein the hinged frame surrounds the panel to form a hinged push-out screen frame.

4. The push-out screen frame according to claim 1, wherein the closure formation includes an arcuate face extending through an arc of approximately 90° so that the outer face of the arcuate flange portion of the hinged body portion may meet up to close the opening.

5. The push-out screen frame according to claim 1, wherein the or each latching assembly includes a fastening member for fastening to the swinging frame member and a gripping member hingedly attached to the fastening member such that the gripping member may pivot about an axis substantially parallel to the elongate axis of the swinging frame member to which the latching member is attached.

6. The push-out screen frame according to claim 5, wherein the fixed frame members and the gripping member include complementary lip formations having slanted abutment faces such that the gripping member and the fixed members with which they may engage may be locked against unintended disengagement.

7. The push-out screen frame according to claim 6, wherein a spring, is interposed between the fastening member and the gripping member for biasing the gripping member away from the fixed frame member and into engagement with the swinging frame member as it is pivoted towards the closure of the opening formed by the fixed frame members by the hinged frame.

8. The push-out screen frame according to claim 1, wherein the locking member includes a C-section flange along one edge of the locking body for attaching the locking member to the swinging frame member.

9. The push-out screen frame according to claim 8, wherein the fixed frame members include a complementary C-section flange, the inner face of the C-section flange being sized for partially surrounding the outer face of the complementary C-section flange, thereby providing hinged pivotal movement between the locking member and the swinging frame member with which the locking member is associated.

* * * * *